US007712879B2

(12) United States Patent
Barbet

(10) Patent No.: US 7,712,879 B2
(45) Date of Patent: May 11, 2010

(54) DROP CHARGE AND DEFLECTION DEVICE FOR INK JET PRINTING

(75) Inventor: Bruno Barbet, Etoile sur Rhone (FR)

(73) Assignee: Imaje S.A., Bourg les Valence (FR)

( * ) Notice: Subject to any disclaimer, the term of this patent is extended or adjusted under 35 U.S.C. 154(b) by 230 days.

(21) Appl. No.: 11/991,508

(22) PCT Filed: Sep. 11, 2006

(86) PCT No.: PCT/EP2006/066248

§ 371 (c)(1),
(2), (4) Date: Mar. 4, 2008

(87) PCT Pub. No.: WO2007/031500

PCT Pub. Date: Mar. 22, 2007

(65) Prior Publication Data

US 2009/0153627 A1 Jun. 18, 2009

Related U.S. Application Data

(60) Provisional application No. 60/737,965, filed on Nov. 18, 2005.

(30) Foreign Application Priority Data

Sep. 13, 2005 (FR) ..... 05 52759

(51) Int. Cl.
*B41J 2/085* (2006.01)

(52) U.S. Cl. ..... 347/76

(58) Field of Classification Search ..... 347/76, 347/73–75, 77, 79, 80, 82, 44
See application file for complete search history.

(56) References Cited

U.S. PATENT DOCUMENTS

| | | | | |
|---|---|---|---|---|
| 3,373,437 | A | 3/1968 | Sweet et al. | |
| 3,596,275 | A | 7/1971 | Sweet | |
| 4,346,387 | A | 8/1982 | Hertz | |
| 4,350,986 | A | 9/1982 | Yamada | |
| 5,070,341 | A | 12/1991 | Wills et al. | |
| 6,273,559 | B1 | 8/2001 | Vago et al. | |
| 7,273,270 | B2 * | 9/2007 | Katerberg | 347/76 |
| 7,364,276 | B2 * | 4/2008 | Piatt et al. | 347/74 |

(Continued)

FOREIGN PATENT DOCUMENTS

| | | |
|---|---|---|
| EP | 0911167 | 10/1998 |

(Continued)

OTHER PUBLICATIONS

International Preliminary Search Report, PCT/EP2006/066248, dated Sep. 13, 2005.

*Primary Examiner*—K. Feggins
(74) *Attorney, Agent, or Firm*—Nixon Peabody LLP

(57) ABSTRACT

Ink jet printing method, in which the jet (14) is broken up in small and large drops at a fixed point (B), and the drops (16*a*, 16*b*) are charged according to the length (l, L) of the break segment (18), in other words according to their diameter. This configuration overcomes transition problems.

The charging means (22) can also selectively deflect drops (16*b*).

13 Claims, 3 Drawing Sheets

U.S. PATENT DOCUMENTS

| | | | | |
|---|---|---|---|---|
| 2003/0156169 | A1 * | 8/2003 | Martin et al. | 347/77 |
| 2003/0222950 | A1 | 12/2003 | Jeanmaire | |

FOREIGN PATENT DOCUMENTS

| | | | |
|---|---|---|---|
| EP | 0911161 | A2 | 4/1999 |
| EP | 0911165 | A2 | 4/1999 |
| EP | 0911166 | A2 | 4/1999 |
| EP | 0949077 | | 10/1999 |
| EP | 1092542 | | 4/2001 |
| EP | 1219429 | | 7/2002 |
| GB | 1521889 | | 8/1978 |
| GB | 1528269 | | 10/1978 |
| JP | 60004065 | | 1/1985 |

* cited by examiner

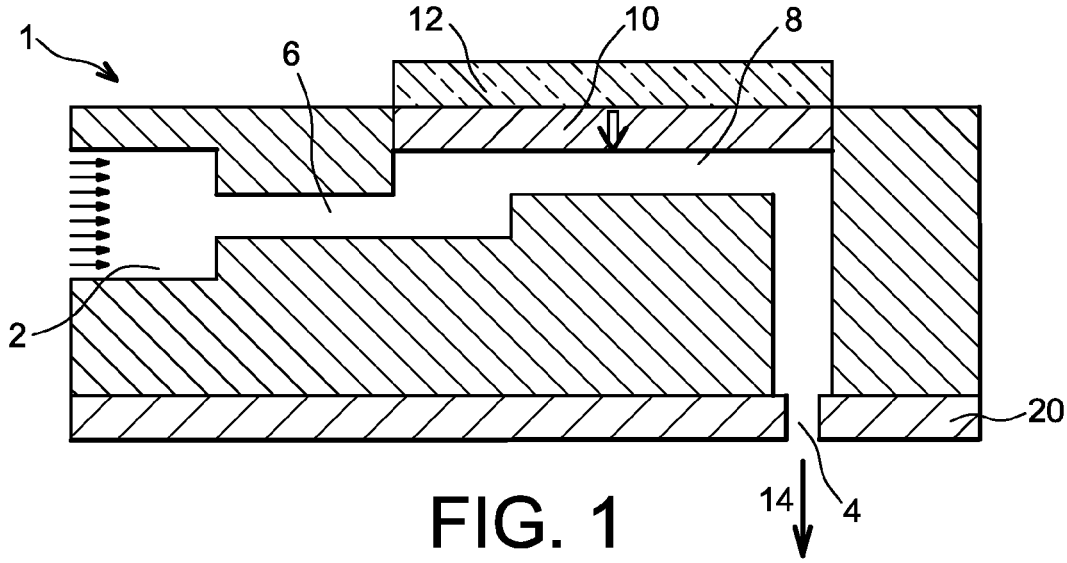
FIG. 1
FIG. 3a
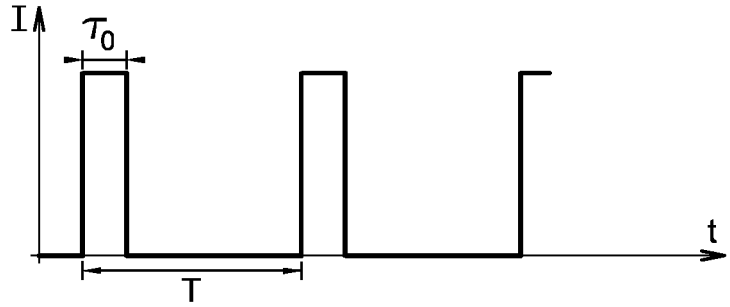
FIG. 3b
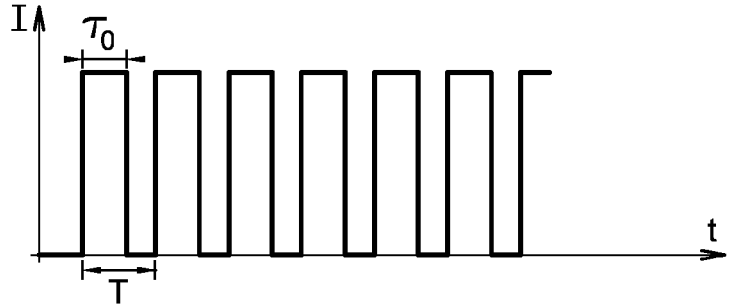
FIG. 3c
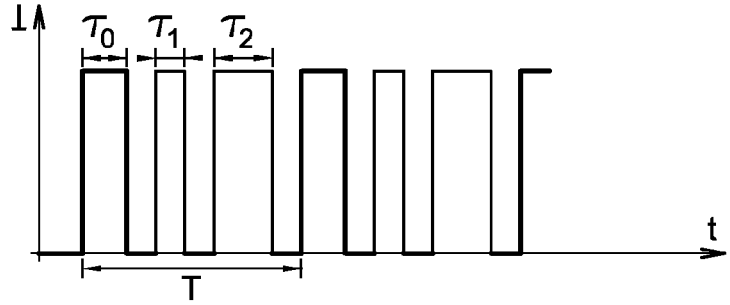

DROP CHARGE AND DEFLECTION DEVICE FOR INK JET PRINTING

CROSS REFERENCE TO RELATED APPLICATIONS OR PRIORITY CLAIM

This application is a national phase of International Application No. PCT/EP2006/066248 entitled "Drop Charge And Deflection Device For Ink Jet Printing", which was filed on Sep. 11, 2006, which was published in English, and which claims priority of the French Patent Application No. 05 52759 filed Sep. 13, 2005 and U.S. 60/737,965 Provisional Application filed Nov. 18, 2005.

TECHNICAL FIELD

The invention is in the field of liquid projection that is inherently different from atomisation techniques, and more particularly of controlled production of calibrated droplets, for example used for digital printing.

The invention relates particularly to selective deviation of droplets for which one preferred but not exclusive application field is ink jet printing. The device according to the invention relates to any asynchronous liquid segment production system in the continuous jet field, as opposed to drop-on-demand techniques.

BACKGROUND ART

Typical operation of a continuous jet printer may be described as follows: electrically conductive ink is kept under pressure in an ink reservoir. The ink reservoir feeds a chamber that contains ink to be stimulated by means of an ink stimulation device. Working from the inside outwards, the stimulation chamber comprises at least one ink passage to a calibrated nozzle drilled in a nozzle plate: pressurised ink flows through the nozzle, thus forming an ink jet.

The ink jet thus formed breaks up at a well defined point downstream the nozzle plate and produces ink droplets at regular time intervals under the action of the periodic stimulation device housed in the ink chamber; this forced fragmentation of the ink jet is induced at a point called the drop break up point by the periodic vibrations of the stimulation device located in the ink contained in the ink reservoir.

Starting from the break up point, the continuous jet is transformed into a sequence of ink drops. A variety of means is then used to select drops that will be directed towards a substrate to be printed or towards a recuperation device commonly called a gutter. Therefore the same continuous jet is used for printing or for not printing the substrate in order to make the required printed patterns.

Such continuous jet printers may comprise several print nozzles operating simultaneously and in parallel, in order to increase the print surface area and therefore the print speed.

Usual drop selection means comprise a first group of electrodes close to the break up point called charging electrodes, the function of which is to selectively transfer a predetermined electrical charge to each drop. All drops in the jet, some of which having been charged, then pass through a second arrangement of electrodes called the deflection electrodes generating an electrical field that will modify the trajectory of the drops depending on their charge.

This electrostatic deflection of liquid drops issued from fragmentation of a continuous jet is a solution widely used in ink jet printing. For example, the deviated continuous jet variant described in document U.S. Pat. No. 3,596,275 (Sweet) consists of providing a multitude of voltages to charge drops with a predetermined charge, at an application instant synchronised with the generation of drops so as to accurately control a multitude of drop trajectories. The positioning of droplets on only two preferred-trajectories associated with two charge levels results in a binary continuous jet print technology described in document U.S. Pat. No. 3,373,437 (Sweet).

For all these devices, the charging signal is determined according to the trajectory to be followed by the drop, and other factors. The main disadvantages of this concept for use with multiple jets are firstly the need to place different electrodes close to each jet, and secondly to control each electrode individually.

Another approach consists of setting the charging potential and varying the stimulation signal to move the jet break up location: the quantity of charge carried by each drop and consequently the drop trajectory will be different, depending on whether the drop is formed close to or far from a charging electrode common to the entire array of jets. The set of charging electrodes may be more or less complex: a multitude of configurations is explored in document U.S. Pat. No. 4,346,387 (Hertz). The major advantage of this approach is the mechanical simplicity of the electrode block, but transitions between two deflection levels cannot be easily managed: the transition from one break up point to another produces a series of drops with uncontrolled intermediate trajectories.

Solutions have been considered to overcome this difficulty comprising a modulation of the break length in EP 0 949 077 (Imaje), but with a tight tolerance on the break up length (typically a few tens of microns) that is difficult to control; or management of partially charged portions of the jet with a length equivalent to the distance separating two clearly defined break up locations in EP 1 092 542 (Imaje), but this requires management of two break up points and the useful drop generation frequency has to be reduced, with the production of unusable jet segments.

In general, even for recent developments such as developments made by the Kodak company for its drop generator based on a thermal stimulation technique allowing exceptional drop production ways (for example EP 0 911 167), the solutions put forward always have the problem of transitions between the deflected position of the jet and the undeflected one.

One alternative suggested the presence of different sized drops and selective deflection according to the drop sizes by crosswise projection of an airflow, as described in US 2003/0222950. However in this case, the production, circulation and recovery of a uniform airflow are difficult to implement without increasing air induced fluctuations along the trajectory of the drops.

SUMMARY OF THE INVENTION

One of the advantages of the invention is to overcome the disadvantages of existing print heads; the invention relates to the definition of a trajectory for drops according to their size.

More generally, the invention relates to means of charging drops issued from a continuous jet depending on the length of the segment of the jet from which they were generated, and particularly their diameter, without any action on their break up point: the charge of the drops, and therefore the future deflection, are determined when the jet is disturbed, without the need to modify control settings on the downstream side of the charge and deflexion means. According to the invention, drops with different diameters are not formed through breaking up a jet having a varying diameter, but through breaking up a cylindrical jet at the same break up point but at varying time intervals so that the jet forms segments with different lengths; the surface tension thus will form smaller and larger drops. The cylindrical shape factor of each segment is such that its length is greater than its diameter: no quasi-spherical portion of a jet is produced, contrary to the prior art.

According to one aspect, the invention relates to a device for generating selectively charged drops from a reservoir of pressurised conductive liquid. The device comprises means to perturb the jet radius so as to break it up into segments with first and second lengths, the break up point being practically at the same distance from the ejection nozzle regardless of the length of the segments; advantageously, a large number of nozzles are provided so as to obtain an array of jets, preferably each jet being controlled individually. According to one advantageous embodiment, the jet disturbance means comprise a piezoelectric actuator acting on the chamber, for example through a membrane and activated by an electrical stimulation signal.

The device also comprises means of charging at least some segments, these charging means comprising an element at a fixed electrical potential located around the jet break up point. The charging means selectively transfer a charge to the jet segment while it breaks off from the continuous jet at a given distance from nozzle, the called jet break up point; in general, the electrical field generated by the charging means acts along the segment length. Each segment can generate a drop, in which case the charge transferred to the drops is different depending on the drop diameter, due to the difference in the length of the cylindrical jet segment from which they are issued. It is also possible that the shorter successive segments will coalesce again, joining together and thus forming larger drops: for example, the jet produces uniform diameter drops but with different charges.

Different configurations are envisaged for the charging means. According to one embodiment, the charging means comprises a first electrode with a clearance around the break up point, and a second electrode on the downstream side: small drops are formed inside the clearance while segments forming the large drops project outside the clearance and are charged by the second electrode. This second electrode can also act as a means of deflecting large drops relative to small drops.

According to another embodiment, the charging means comprise a block with several successive electrodes, particularly two electrodes, in plate form. The small drops are formed in front of the first electrode and are charged only by the first electrode, while the large drops are affected by the influence of the other electrode such that the embedded charge is different depending on the size of the drops and/or the length of the segment from which they are coming from.

The device according to the invention advantageously comprises deflection means, usually an electrode, downstream of where the charged drops are formed, so as to differentiate the trajectory of the drops.

According to another aspect, the invention relates to a method for selectively charging drops depending on the length of the segment from which they are derived at the time of their formation by the breaking up of a continuous jet, wherein the charge is transferred by at least one electrode to the segments being formed according to their length. Once the charge has been transferred, a differential deflection may be provoked between different sized drops or drops with a different origin. The segments are advantageously formed at the same break up point regardless of their length by a disturbance of the continuous jet by a stimulation pulse with an appropriate amplitude and duration, applied on a piezoelectric actuator.

The device and the method according to the invention are particularly suitable for an ink jet print head, the drops being discriminated for printing and for recuperation.

BRIEF DESCRIPTION OF THE DRAWINGS

Other characteristics and advantages of the invention will become clearer after reading the following description with reference to the attached drawings, given as illustrations and that are in no way limitative.

FIG. 1 shows a sectional view of a drop generator suitable for the device according to the invention.

FIG. 3 shows a description of the piezoelectric actuator control signal.

DETAILED PRESENTATION OF PARTICULAR EMBODIMENTS

Figure 2:
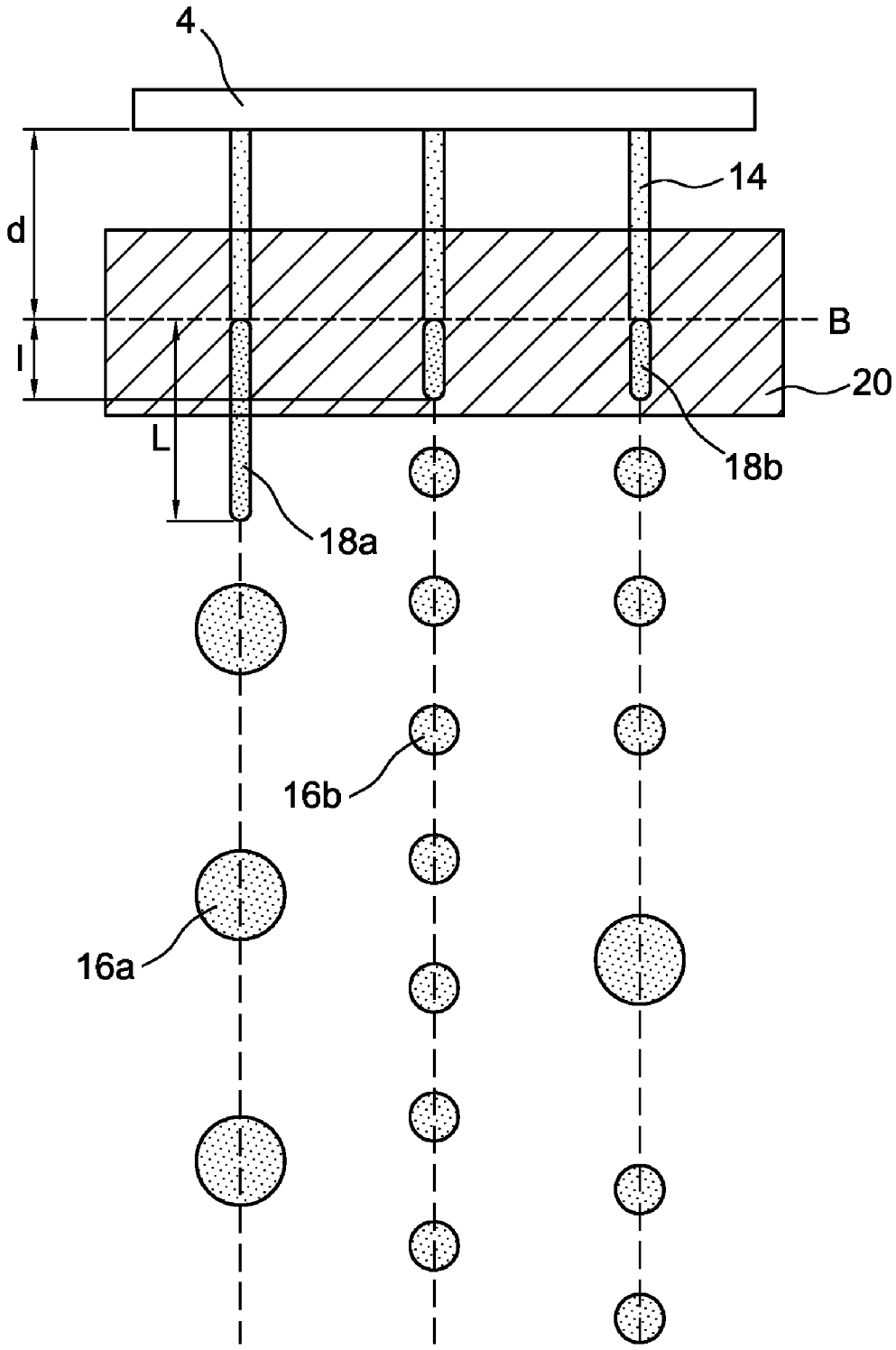
FIG. 2 illustrates the principle of generating drops and charge according to the invention.

The charging device according to the invention takes advantage of the fact that drops may be produced on demand with different diameters within the continuous jet: the ink jet may be broken into variable length segments that may or may not be grouped again, thus forming larger or smaller drops, depending on the disturbance repetition pattern applied to it.

The production of the drops is not induced by varying the diameter of the jet itself: contrary to an ejection process as e.g. disclosed in document U.S. Pat. No. 4,350,986 (Hitachi), there is no modification of the jet so as to form portions with smaller and larger diameters between which the jet would break up to form smaller and larger drops. According to the invention, the jet remains substantially cylindrical and it breaks up into substantially cylindrical segments.

Furthermore, according to the invention and unlike prior art, drops are formed due to the jet breakoff at a practically constant distance from the ejection nozzle, in other words at a fixed point with respect to the charging electrode, regardless of the length of the segment and the diameter of the drop considered. In particular, unlike the device described in EP 1 092 542 (Imaje) in which the drops and the segments separate from the continuous jet at different distances from the nozzle, according to the invention the stimulation is such that the jet breaks up at the same location, and that the length projecting from this break up point forming the segment or the drop differs.

A drop generator 1 that is particularly suitable for the invention is illustrated in FIG. 1, although other types of generators and particularly thermal generators may be envisaged. Pressurized ink is supplied to a secondary reservoir 2 internal to the generator 1; the reservoir 2 distributes ink to a network of nozzles 4, only one of which is shown on the section in FIG. 1. Each nozzle 4 is supplied by an individual hydraulic path that comprises a sequence of channels; in particular, one of the channels 6 performs a restriction function, and a second channel 8 is a stimulation chamber, in other words a cavity filled with ink in which one of the faces, for example a membrane 10, deforms under the action of a piezoelectric actuator 12.

The ink volume trapped in the chamber 8 varies according to the action of the piezoelectric element 12 itself controlled by an electrical voltage: the effect of this action is to modulate the radius of the liquid jet 14 emitted by the nozzle 4.

Preferably, each jet 14 issued from the generator 1 may be controlled individually and similarly. If there is no stimulation, ink flows through each nozzle 4 forming a continuous cylindrical liquid jet 14. This jet 14 is fragmented into droplets 16 in a controlled manner (see FIG. 2) when an electrical signal called the stimulation signal is applied to the piezoelectric element 12, thereby modifying the pressure on the liquid.

The stimulation signal is typically in the form of pulses, as illustrated in FIG. 3*a*: the consequence of the pulse with duration To is to locally disturb the jet 14, leading to fragmentation into segments 18 (depending on the duration and intensity of the electrical pulse) thanks to fluid mechanics laws and that will form drops 16, due to surface tension phenomena. Furthermore, if the repetition of pulses To is periodic and constant, fragmentation is controlled with a production of segments 18*a* with a calibrated length producing identically sized equidistant droplets 16*a*: see FIG. 2.

By acting on stimulation time intervals, in other words by repeating pulses at a variable frequency, it is possible to vary the size of the drops produced. In particular, a variable duration stoppage of the stimulation provides the means of controlling the length of the segment: all that is necessary to form a small drop 16*b* is to reduce the segment length 18*b* and therefore to temporarily stop stimulation for a shorter time: see FIG. 3*b*.

A suitable generator may also operate in multi-jets, for example by forming an array of jets, typically 100 jets located in the same plane, at a pitch of 250 μm: the illustrated nozzle 4 forms part of a plate comprising a large number of nozzles. Each stream 14 flowing from the plate is controlled by an independent piezoelectric actuator 12 and is to be broken up into segments 18 with a predefined length, for example less than 1 mm.

According to the invention, the jet breakup occurs at a fixed point B of the jet, in other words at a clearly defined distance d from the nozzle plate 4, preferably in the clearance of a charging element 20 prolonging the nozzle plate and that will be described in detail later.

As illustrated in FIG. 2 (FIGS. 3*a* and 3*b* illustrate the associated electrical signals) and depending on the stimulation signal, the jet 14 produces the following downstream of the break up point B:

long cylindrical jet segments 18*a* with length L, forming large diameter spherical drops 16*a;* short cylindrical jet segments 18*b* with length l, forming small diameter spherical drops 16*b*.

These different diameter drops may be alternated in a controlled and regular manner, by modifying the interval T between pulses.

According to the invention, the liquid charge, and particularly the conductive ink charge, is applied selectively to the large and the small drops 16*a*, 16*b* by the presence of means creating an electrical field on the downstream side of their formation point B and according to the length l, L of the jet segment 18*a*, 18*b*. Indeed, a charging electrostatic field will be entered by an individualized segment 18*a*, or by a segment 18*b* yet coupled to the jet 14, depending on the length l, L thereof. The charging means and the deflection means are advantageously unique for a complete array of jets and all drops formed by a print head.

According to one preferred embodiment, the ink and the generator 1 are grounded, at least some drops are charged as they are being formed, and drops are deflected by an electrode brought to a sufficient electrical potential; however, in the examples presented hereinafter, it is possible to have ink at a different potential, in which case the electrical potentials of the charging and deflection electrodes have relative values according to this aspect.

Figure 4:
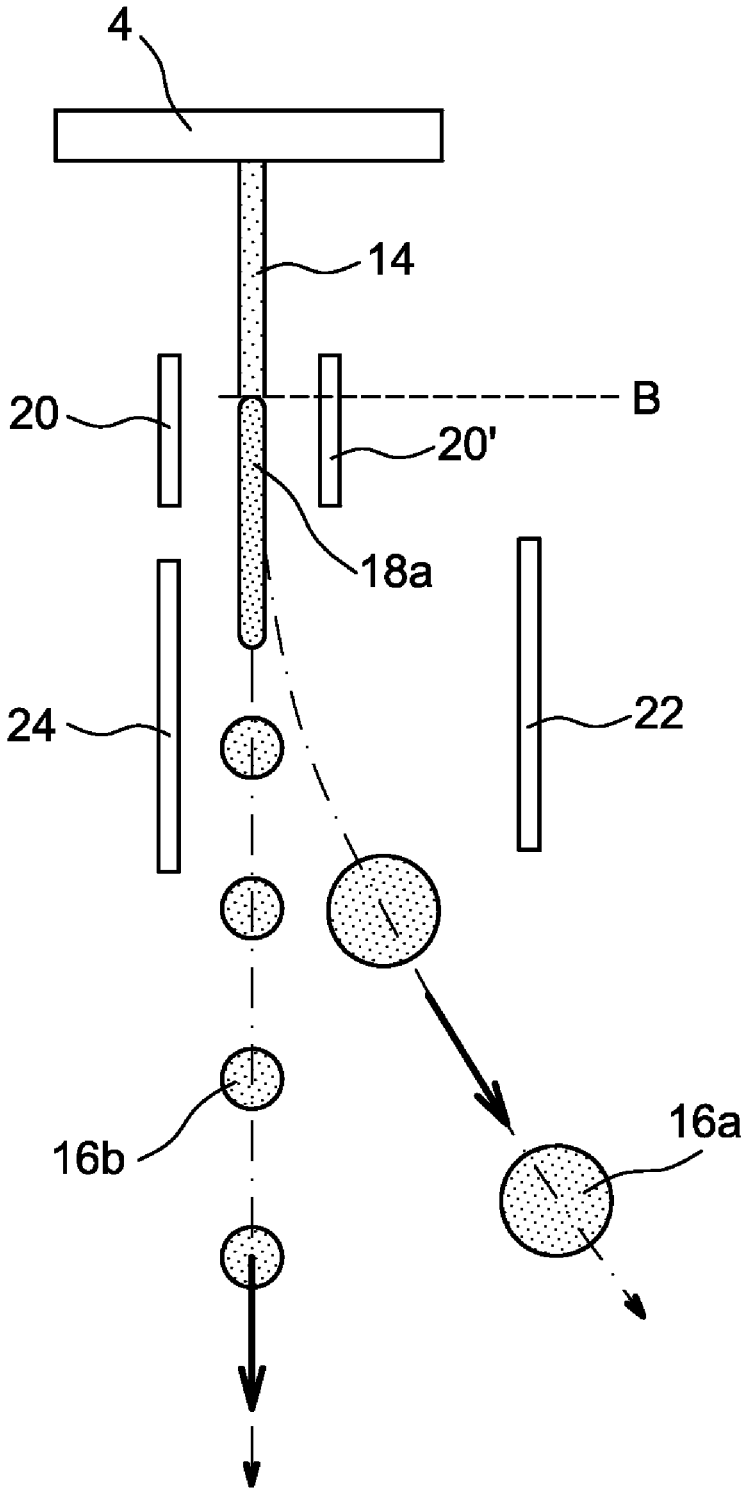
FIG. 4 shows a preferred embodiment of the invention.

According to one preferred embodiment illustrated in FIG. 4, the charge of the drops is applied on the downstream side of where the small drops 16*b* are formed: the charging element 20 comprises a conducting plate in the clearance of which the short segment 18*b* is formed; the conducting plate 20 is brought to a first potential V1 that is preferably identical to the potential of the stream 14 and the nozzle plate 4, for example the ground. The electrode 20 and the nozzle plate 4 guarantee electrical neutrality of the short segment 18*b* which thus produces an electrically neutral drop 16*b*. Therefore, regardless of the electrical field through which they then pass, the small diameter drops 16*b* do not deviate from their trajectory: their straight-line trajectory forms a reference trajectory.

The charging means also comprise an area with a non-zero electrical field E downstream of the electrode 20, that may be induced by the presence of an electrode 22 brought to a very high electrical potential. The presence of the very high potential 22 on the downstream side of the electrode 20 is such that any jet portion projecting downstream of the electrode clearance 20 may be charged by this electrode 22. The long segment 18*a* is generated such that it projects outside the electrode 20, and therefore it is electrically charged by the field E. Thus different diameter drops 16*a*, 16*b* are generated through different length segments 18*a*, 18*b*, the difference in diameter being accompanied by a difference in charge, the difference in charge being achieved thanks the shape factor of the segments and enabling selective deflection of drops according to their size. This deflection may be achieved directly by the charge electrode 22.

Thus, with this configuration, a single electrode 22 can be used to charge the downstream part of the long segment 18*a* (for example half of it), and then to deflect the resulting spherical drop 16*a*, that is attracted by the field E. At the exit from the deflection field E (at the exit from the electrode 22), the charged drops 16*a* continue their path along the tangent to their deflection, in other words along a direction different to the reference trajectory of the uncharged drops 16*b*. The deflected drops 16*a* can thus be collected in a gutter, so that only the small drops 16*b* will be printed on a substrate.

Obviously, conversely it is possible to print the large drops 16*a* and to collect the small drops in a gutter, particularly if the small drops 16*b* are the drops that are charged after the method (for example if the ink and the generator are not connected to the ground and if the electrode 22 cancels the charge).

The thickness of the electrode 20 on the downstream side of the break up point B is calibrated SO that it is equal to at least the length 1 of the short segment 18*b*. For improving the quality of electrical shielding and to tolerate a margin of error in the length 1 of short segments 18*b* and in the break up point B, it is useful to extend the electrode 20 on each side of the segment 18*b*, in other words particularly on the upstream side of the break up point B. Preferably, the bottom of the electrode 20 is located at the middle of the long segment 18*a*, in other words the thickness of the electrode 20 may be of the order of d+L/2 if it is directly connected to the nozzle plate 4.

The formation of small and large drops as described above is not limitative. For example, it would be possible to use a signal like that illustrated in FIG. 3*c*, with a series of pulses applied to piezoelectric actuators 12: the base signal is composed of a pulse with duration $\tau_0$, at a repetition frequency F=1/T. The period T combined with the jet flow speed 14 determines the length of the long segment 18*a*. The time difference $T-\tau_0$ defines the rest period. Additional pulses $\tau_1$, $\tau_2, \ldots, \tau_n$ occurring during the rest period of the base signal are then used to break up the jet segment associated with period T into n+1 segments.

The pulse durations $\tau_i$ and the intermediate rest periods may be adjusted, for example to produce short segments 18*b* (and therefore small drops 16*b*) with identical size; however, these values can also be chosen to control the shrinkage dynamics of short segments 18*b* by their charge per unit mass by making them re-coalesce (in other words re-unify them downstream their formation), so as to form a spherical drop 16*a* almost exactly the same size as the drop produced by a long segment 18*a*. Thus, this approach provides a means of producing identically sized drops 16*a* but with different charges (actually electrically charged or not charged), depending on whether they originate from a long segment 18*a* or from short segments 18*b* merging together.

The deflection device proposed in FIG. 4 thus provides a means of placing ink droplets 16 on two different trajectories, that can therefore be selected to print or not print, this selection being made at the time of the piezoelectric stimulation 12.

If the example embodiment described creates a neutral drop trajectory, in other words along the hydraulic axis of the jet 14, more generally two trajectories of charged drops can be obtained with different charge/mass ratios depending on the configuration of the first charge element 20. For example, according to one variant, the electrode 20 may be replaced by a single plane electrode (shown diagrammatically in FIG. 4 as single part 20' only of the electrode 20) on the same side as the electrode 22: the short segments 18*b* are then only slightly charged, while the long segments 18*a* are strongly charged. This charge differential may be adjusted by placing an additional optional electrode 24 (or set of electrodes) that reinforces electrostatic coupling of long segments with the electrode 22 and forms a screen between the short segments and the electrode 22 (the special case of the electrode described above is actually a total screen). Moreover the electrode 24 enhances the deflecting electrical field thus reinforcing the deviation of droplet 16*a*. It is naturally possible to set up more than two successive electrodes 20', 22, particularly if a multiple deflection is envisaged.

The device according to the invention thus provides a way of placing droplets of an electrically conductive liquid derived from fragmentation of a continuous jet, on two different trajectories. The following advantages are obtained, while overcoming the disadvantages mentioned according to prior art:

The set of individual drop charging electrodes is eliminated in the multi-jet device, with the electrodes being common to the array of jets.

On the scale of liquid droplets, the electrodes are very far from the streams and do not require precise mechanical positioning.

Drops are placed on one of the two predefined trajectories according to the drop formation rate; consequently, the electrodes making up the deflection device are at constant potentials.

The invention claimed is:

1. Device for selective charging of conductive liquid drops including:

a pressurised liquid reservoir comprising at least one ejection nozzle of the liquid in the form of a continuous jet;

means of disturbing the jet and thus generating jet segments with adjustable length between a first length and a second length greater than the first length, the jet break up point being approximately at the same distance from the nozzle for all segments;

charging means brought to a constant potential to transfer an electrical charge to a jet segment, the charge transfer being different depending on the length of the segment, comprising a first charging element extending over a first thickness along the trajectory of the jet from the break up point, and a second charging element downstream of the first charging element along the trajectory of the jet.

2. Device according to claim 1 wherein the first charging element includes an electrode, the thickness of which starting from the break up point is between the first and second lengths of the segments, and the second charging element includes an electrode brought to a high potential that may act as a deflection electrode.

3. Device according to claim 1 wherein the charging means include at least two electrodes approximately aligned along the trajectory of the jet forming the two charging elements.

4. Device according to claim 3 wherein the charging means include at least one additional electrode placed opposite the two charging elements with respect to the trajectory of the jet.

5. Device according to claim 1 comprising a multitude of nozzles used to generate an array of jets, the charging means being unique for the array of jets.

6. Device according to claim 1, wherein the means for disturbing the jet include a piezoelectric actuator used to break up the jet at a single location regardless of the length of the segment.

7. Print head including a device according to claim 1, and means of recovering ink from the drops originating from first or second length segments.

8. Method for selectively charging drops depending on the length of the segment from which they are issued, comprising:

the formation of a continuous jet of conductive liquid derived from a pressurised chamber;

disturbance of the jet to generate segments with first length and segments with second length greater than the first length by breaking up the jet at a fixed point;

charging the segment derived from the breaking up by an electrical field according to its length.

9. Method according to claim 8 wherein the jet disturbance is such that the first and second length segments form drops with first and second diameters.

10. Method according to claim 8 wherein the jet disturbance creates coalescence of segments with first length downstream their formation.

11. Method according to claim 8 comprising the formation of an array of continuous jets and disturbance of each of the formed jets.

12. Method according to claim 8, further comprising deflection of drops depending on their charge.

13. Ink jet print method comprising the method according to claim 12, printing of the drops originating from segments of the first or the second length and recovery of the other drops.

* * * * *